US007778825B2

(12) United States Patent
Kim

(10) Patent No.: US 7,778,825 B2
(45) Date of Patent: Aug. 17, 2010

(54) METHOD AND APPARATUS FOR EXTRACTING VOICED/UNVOICED CLASSIFICATION INFORMATION USING HARMONIC COMPONENT OF VOICE SIGNAL

(75) Inventor: Hyun-Soo Kim, Yongin-si (KR)

(73) Assignee: Samsung Electronics Co., Ltd (KR)

( * ) Notice: Subject to any disclaimer, the term of this patent is extended or adjusted under 35 U.S.C. 154(b) by 1069 days.

(21) Appl. No.: 11/485,690

(22) Filed: Jul. 13, 2006

(65) Prior Publication Data

US 2007/0027681 A1 Feb. 1, 2007

(30) Foreign Application Priority Data

Aug. 1, 2005 (KR) ..... 10-2005-0070410

(51) Int. Cl.
*G10L 11/06* (2006.01)

(52) U.S. Cl. ..... 704/208

(58) Field of Classification Search ..... 704/208
See application file for complete search history.

(56) References Cited

U.S. PATENT DOCUMENTS

| | | | | |
|---|---|---|---|---|
| 5,809,455 | A * | 9/1998 | Nishiguchi et al. | 704/214 |
| 6,003,001 | A | 12/1999 | Maeda | |
| 6,023,671 | A * | 2/2000 | Iijima et al. | 704/214 |
| 6,233,550 | B1 * | 5/2001 | Gersho et al. | 704/208 |
| 6,475,245 | B2 * | 11/2002 | Gersho et al. | 704/208 |
| 7,472,059 | B2 * | 12/2008 | Huang | 704/220 |
| 7,516,067 | B2 * | 4/2009 | Seltzer et al. | 704/226 |
| 2002/0111798 | A1 | 8/2002 | Huang | |
| 2003/0182105 | A1 | 9/2003 | Sall et al. | |

FOREIGN PATENT DOCUMENTS

| | | | |
|---|---|---|---|
| CN | 1543639 | | 11/2004 |
| JP | 03288199 | A | 12/1991 |
| JP | 04116700 | | 4/1992 |
| JP | 09-237100 | | 9/1997 |
| JP | 10-020888 | | 1/1998 |
| JP | 10-20891 | | 1/1998 |
| JP | 10-097296 | | 4/1998 |
| JP | 10-222194 | | 8/1998 |
| JP | 200117746 | | 6/2001 |
| JP | 2002162982 | | 6/2002 |
| KR | 1998-024790 | | 7/1998 |
| KR | 1020030070178 | | 8/2003 |

* cited by examiner

*Primary Examiner*—Susan McFadden
(74) *Attorney, Agent, or Firm*—The Farrell Law Firm, LLP

(57) ABSTRACT

An apparatus and method for extracting precise voiced/unvoiced classification information from a voice signal is provided. The apparatus extracts voiced/unvoiced classification information by analyzing a ratio of a harmonic component to a non-harmonic (or residual) component. The apparatus uses a harmonic to residual ratio (HRR), a harmonic to noise component ratio (HNR), and a sub-band harmonic to noise component ratio (SB-HNR), which are feature extracting schemes obtained based on a harmonic component analysis, thereby precisely classifying voiced/unvoiced sounds. Therefore, the apparatus and method can be used for voice coding, recognition, composition, reinforcement, etc. in all voice signal processing systems.

24 Claims, 6 Drawing Sheets

METHOD AND APPARATUS FOR EXTRACTING VOICED/UNVOICED CLASSIFICATION INFORMATION USING HARMONIC COMPONENT OF VOICE SIGNAL

PRIORITY

This application claims the benefit under 35 U.S.C. 119(a) of an application entitled "Method And Apparatus For Extracting Voiced/Unvoiced Classification Information Using Harmonic Component Of Voice Signal" filed in the Korean Intellectual Property Office on Aug. 1, 2005 and assigned Serial No. 2005-70410, the entire contents of which are incorporated herein by reference.

BACKGROUND OF THE INVENTION

1. Field of the Invention

The present invention relates to a method and apparatus for extracting voiced/unvoiced classification information, and more particularly to a method and apparatus for extracting voiced/unvoiced classification information using a harmonic component of a voice signal, so as to accurately classify the voice signal into voiced/unvoiced sounds.

2. Description of the Related Art

In general, a voice signal is classified into a periodic (or harmonic) component and a non-periodic (or random) component (i.e. a voiced sound and a sound resulting from sounds or noises other than a voice, herein after referred to as an "unvoiced sound") according to its statistical characteristics in a time domain and a frequency domain, so that the voice signal is called a "quasi-periodic" signal. In this case, a periodic component and a non-periodic component are determined as being a voiced sound and a unvoiced sound according to whether pitch information exists, the voiced sound having a periodic property and the unvoiced sound having a non-periodic property.

As described above, voiced/unvoiced classification information is the most basic and critical information to be used for coding, recognition, composition, reinforcement, etc., in all voice signal processing systems. Therefore, various methods have been proposed for classifying a voice signal into voiced/unvoiced sounds. For example, there is a method used in a phonetic coding, whereby a voice signal is classified into six categories including an onset, a full-band steady-state voiced sound, a full-band transient voiced sound, a low-pass transient voiced sound, and low-pass steady-state voiced and unvoiced sounds.

Particularly, features used for voiced/unvoiced classification include a low-band speech energy, zero-crossing count, a first reflection coefficient, a pre-emphasized energy ratio, a second reflection coefficient, casual pitch prediction gains, and non-casual pitch prediction gains, which are combined and used in a linear discriminator. However, since there is not yet a voiced/unvoiced classification method using only one feature, the performance for voiced/unvoiced classification is greatly influenced depending on how to combine a plurality of these features.

Meanwhile, during voicing, since a higher power is output by a vocal system (i.e. a system of making a voice signal), a voiced sound occupies a great portion of a voice energy, so that a distortion of a voiced portion in a voice signal exerts a great effect upon the entire sound quality of a coded speech.

In such a voiced speech, since interaction between glottal excitation and the vocal tract causes difficulty for spectrum estimation, measurement information with respect to a degree of voicing is necessarily required in most of voice signal processing systems. Such measurement information is also used in voice recognition and voice coding. Particularly, since the measurement information is an important parameter to determine the quality of sound in voice composition, use of wrong information or a misestimated value results in performance degradation in voice recognition and composition.

However, since an estimated phenomenon itself includes randomness to some degree as its characteristic, such an estimation is performed in a predetermined period, and the output of a voicing measure includes a random component. Therefore, a statistical performance measurement scheme may be used appropriately upon evaluation of the voicing measure, and the average of a mixture estimated using a great number of frames is used as a primary index (indicator).

As described above, although there are a plurality of features used to extract voiced/unvoiced classification information in the prior art, it is impossible to classify voiced/unvoiced sounds by a single feature. Therefore, voiced/unvoiced sounds have been classified by using a combination of features, any one of which cannot provide reliable information by itself. However, the conventional methods have a correlation problem between the features and a performance degradation problem due to noise, so a new method capable of solving these problems has been required. Also, the conventional methods do not properly express the existence of a harmonic component and a degree of harmonic component, which are essential differences between a voiced sound and a unvoiced sound. Therefore, it is necessary to develop a new method capable of accurately classifying voiced/unvoiced sounds through the analysis of a harmonic component.

SUMMARY OF THE INVENTION

Accordingly, the present invention has been made to meet the above-mentioned requirement, and the present invention provides a method and apparatus for extracting voiced/unvoiced classification information by using harmonic component analysis of a voice signal, so as to more accurately classify voiced/unvoiced sounds.

To this end, the present invention provides a method for extracting voiced/unvoiced classification information using a harmonic component of a voice signal, the method including: converting an input voice signal into a voice signal of a frequency domain; calculating a harmonic signal and a residual signal except for the harmonic signal from the converted voice signal; calculating a harmonic to residual ratio (HRR) using a calculation result of the harmonic signal and residual signal; and classifying voiced/unvoiced sounds by comparing the HRR with a threshold value.

Also, the present invention provides a method for extracting voiced/unvoiced classification information using a harmonic component of a voice signal, the method including: converting an input voice signal into a voice signal of a frequency domain; separating a harmonic part and a noise part from the converted voice signal; calculating an energy ratio of the harmonic part to the noise part; and classifying voiced/unvoiced sounds using a result of the calculation.

In addition, the present invention provides an apparatus for extracting voiced/unvoiced classification information using a harmonic component of a voice signal, the apparatus including: a voice signal input unit for receiving a voice signal; a frequency domain conversion unit for converting the received voice signal of a time domain into a voice signal of a frequency domain; a harmonic-residual signal calculation unit for calculating a harmonic signal and a residual signal except for the harmonic signal from the converted voice signal; and a harmonic to residual ratio (HRR) calculation unit for calculating an energy ratio of the harmonic signal to the residual signal using a calculation result of the harmonic-residual signal calculation unit.

In addition, the present invention provides an apparatus for extracting voiced/unvoiced classification information using a harmonic component of a voice signal, the apparatus including: a voice signal input unit for receiving a voice signal; a frequency domain conversion unit for converting the received voice signal of a time domain into a voice signal of a frequency domain; a harmonic/noise separating unit for separating a harmonic part and a noise part from the converted voice signal; and a harmonic to noise energy ratio calculation unit for calculating an energy ratio of the harmonic part to the noise part.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Figure 1:
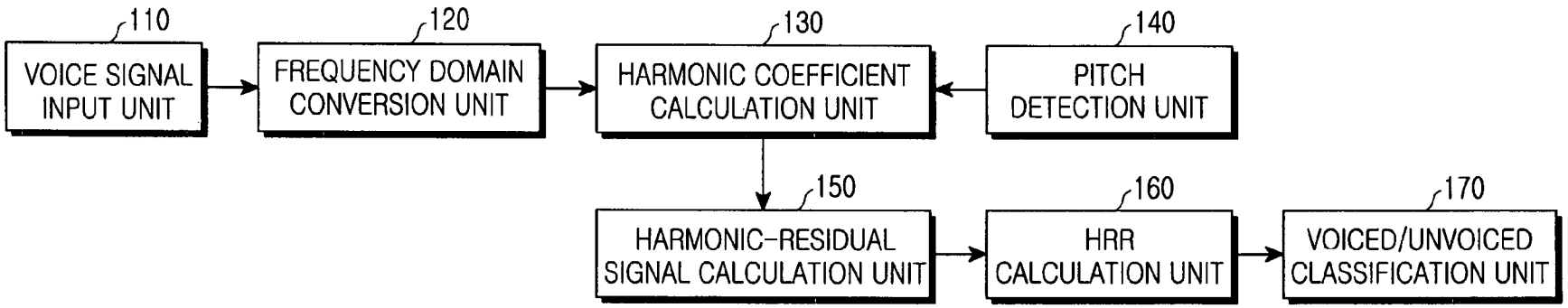
FIG. 1 is a block diagram illustrating the construction of a voiced/unvoiced classification information extracting apparatus according to a first embodiment of the present invention.

Hereinafter, preferred embodiments of the present invention will be described with reference to the accompanying drawings. In the following description of the embodiments of the present invention, a detailed description of known functions and configurations incorporated herein will be omitted when it may obscure the subject matter of the present invention.

The present invention realizes a function capable of improving the accuracy in extracting voiced/unvoiced classification information from a voice signal. To this end, according to the present invention, voiced/unvoiced classification information is extracted by using analysis of a harmonic to non-harmonic (or residual) component ratio. In detail, the voiced/unvoiced sounds can be accurately classified through a harmonic to residual ratio (HRR), a harmonic to noise component ratio (HNR), and a sub-band harmonic to noise component ratio (SB-HNR), which are feature extracting methods obtained based on harmonic component analysis. Since voiced/unvoiced classification information is obtained through theses schemes, the obtained voiced/unvoiced classification information can be used upon the performance of voice coding, recognition, composition, and reinforcement in all voice signal processing systems.

The present invention measures the intensity of a harmonic component of a voice or audio signal, thereby numerically expressing the essential property of voiced/unvoiced classification information extraction.

Prior to the description of the present invention, elements influencing the performance of a voicing estimator will be described.

In detail, these elements include sensitivity to voice composition, insensitivity to pitch behavior (e.g., whether a pitch is high or low, whether a pitch is smoothly changed, whether there is randomness in a pitch interval, etc.), insensitivity to a spectrum envelope, a subjective performance, etc. Actually, since an auditory system is rather insensitive to small changes in voicing intensity, slight errors may be caused in the measurement of the voicing measure, but the most important criterion in performance measurement is the subjective performance by listening.

The present invention provides proposes a classification information extracting method capable of finding voiced/unvoiced classification information (i.e. a feature) to classify voiced/unvoiced sounds, using only a single feature rather than a combination of a plurality of unreliable features, while meeting with the above-mentioned criterion.

The components of a voiced/unvoiced classification information extracting apparatus, in which the above-mentioned function is realized, and their operations will be described. To this end, a voiced/unvoiced classification information extracting apparatus according to a first embodiment of the present invention will be described with reference the block diagram shown in FIG. 1. Hereinafter, according to a construction disclosed in the first embodiment of the present invention, an entire voice signal is represented as a harmonic sinusoidal model of speech, a harmonic coefficient is obtained from the voice signal, and a harmonic signal and a residual signal are calculated using the obtained harmonic coefficient, thereby obtaining an energy ratio between the harmonic signal and the residual signal. In this case, an energy ratio between a harmonic signal and a residual signal is defined as a harmonic to residual ratio (HRR), and voiced/unvoiced sounds can be classified by using the HRR.

Referring to FIG. 1, a voiced/unvoiced classification information extracting apparatus according to the first embodiment of the present invention includes a voice signal input unit 110, a frequency domain conversion unit 120, a harmonic coefficient calculation unit 130, a pitch detection unit 140, a harmonic-residual signal calculation unit 150, an HRR calculation unit 160, and a voiced/unvoiced classification unit 170.

First, the voice signal input unit 110 may include a microphone (MIC), and receives a voice signal including voice and sound signals. The frequency domain conversion unit 120 converts an input signal from a time domain to a frequency domain.

The frequency domain conversion unit 120 uses a fast Fourier transform (FFT) or the like in order to convert a voice signal of a time domain into a voice signal of a frequency domain.

Then, when the frequency domain conversion unit 120 outputs a signal, i.e., an entire voice signal, the entire voice signal can be expressed as a harmonic sinusoidal model of speech. This enables efficient and precise harmonicity measure with only a small amount of calculations. In detail, using a harmonic model, which expresses a voice signal as a sum of harmonics of a fundamental frequency and a small residual, the voice signal may be expressed as shown in Equation 1. That is, since a voice signal can be expressed as a combination of cosine and sine, the voice signal may be expressed as shown in Equation 1.

$$S_n = a_0 + \sum_{k=1}^{L} (a_k \cos n\omega_0 k + b_k \sin n\omega_0 k) + r_n \quad (n = 0, 1, \ldots N-1) \\ = h_n + r_n \tag{1}$$

In Equation 1, "($a_k$ cos $n\omega_0 k$+$b_k$ sin $n\omega_0 k$)" corresponds to a harmonic part, and "$r_n$" corresponds to a residual part except for the harmonic part. Herein, "$S_n$" represents the converted voice signal, "$r_n$" represents a residual signal, "$h_n$" represents a harmonic component, "N" represents the length of a frame, "L" represents the number of existing harmonics, "$\omega_0$" represents a pitch, "k" is a frequency bin number and "a" and "b" are constants which have different values depending on frames. In this case, in order to minimize a residual signal, a procedure of minimizing the value of "$r_n$" in Equation 1 is performed. The harmonic coefficient calculation unit 130 receives a pitch value from the pitch detection unit 140 in order to substitute the pitch value corresponding to "$\omega_0$" into Equation 1. When receiving the pitch value as describe above, the harmonic coefficient calculation unit 130 obtains the values of the "a" and "b" which can minimize a residual energy by the manner described below.

First, when Equation 1 is rearranged with respect to the residual part "$r_n$", $$\text{“}r_n = S_n - h_n\text{”}, \text{ and } h_n = a_0 + \sum_{k=1}^{L} (a_k \cos n\omega_0 k + b_k \sin n\omega_0 k).$$

Meanwhile, the residual energy may be expressed as Equation 2.

$$E = \sum_{n=0}^{N-1} r_n^2 \tag{2}$$

Herein, in order to minimize the residual energy, "$\partial E/\partial a_k=0$" and "$\partial E/\partial b_k=0$" are calculated with respect to every "k".

The harmonic coefficients "a" and "b" are obtained in the same manner as a least squares method, which ensures the minimization of the residual energy while being efficient because only a small amount of calculation is required.

The harmonic-residual signal calculation unit 150 obtains the harmonic coefficients "a" and "b" to minimize the residual energy through the above-mentioned procedure. Then, the harmonic-residual signal calculation unit 150 calculates a harmonic signal and a residual signal by using the obtained harmonic coefficients. In detail, the harmonic-residual signal calculation unit 150 substitutes the calculated harmonic coefficient and the pitch into an equation of $$\text{“}h_n = a_0 + \sum_{k=1}^{L} (a_k \cos n\omega_0 k + b_k \sin n\omega_0 k)\text{”},$$

thereby obtaining a harmonic signal. Since the residual signal "$r_n$" is calculated by subtracting the harmonic signal "$h_n$" from the converted entire voice signal "$S_n$" after the harmonic signal has been obtained, it is possible to calculate the harmonic signal and the residual signal. Similarly, a residual energy can be calculated in a simple manner of subtracting a harmonic energy from the energy of the entire voice signal. Herein, the residual signal is noise-like, and is very small in the case of a voiced frame.

When the harmonic signal and residual signal obtained in the above-mentioned manner is provided to the HRR calculation unit 160, the HRR calculation unit 160 obtains an HRR, which represents a harmonic to residual energy ratio. The HRR may be defined as Equation 3.

$$HRR = 10 \log_{10}(\Sigma h_n^2 / \Sigma r_n^2)\text{dB} \tag{3}$$

When Parseval's theorem is employed, Equation 3 may be expressed as Equation 4 in a frequency domain.

$$HRR = 10\log_{10}\left(\sum_k |H(\omega_k)|^2 \Big/ \sum_k |R(\omega_k)|^2\right)\text{dB} \tag{4}$$

In Equation 4, "ω" represents a frequency bin, H indicates harmonic component $h_n$ and R indicates residual signal $r_n$.

Such a measure is used for extracting classification information (i.e. feature), which represents the degree of a voiced component of a signal in each frame. Obtaining an HRR through such a procedure obtains classification information for classifying voiced/unvoiced sounds.

In this case, a statistical analysis scheme is employed in order to classify voiced/unvoiced sounds. For instance, when a histogram analysis is employed, a threshold value of 95% is used. In this case, when an HRR is greater than −2.65 dB, which is a threshold value, a corresponding signal may be determined as a voiced sound. In contrast, when an HRR is smaller than −2.65 dB, a corresponding signal may be determined as an unvoiced sound. Therefore, the voiced/unvoiced classification unit 170 performs a voiced/unvoiced classification operation by comparing the obtained HRR with the threshold value.

Figure 2:
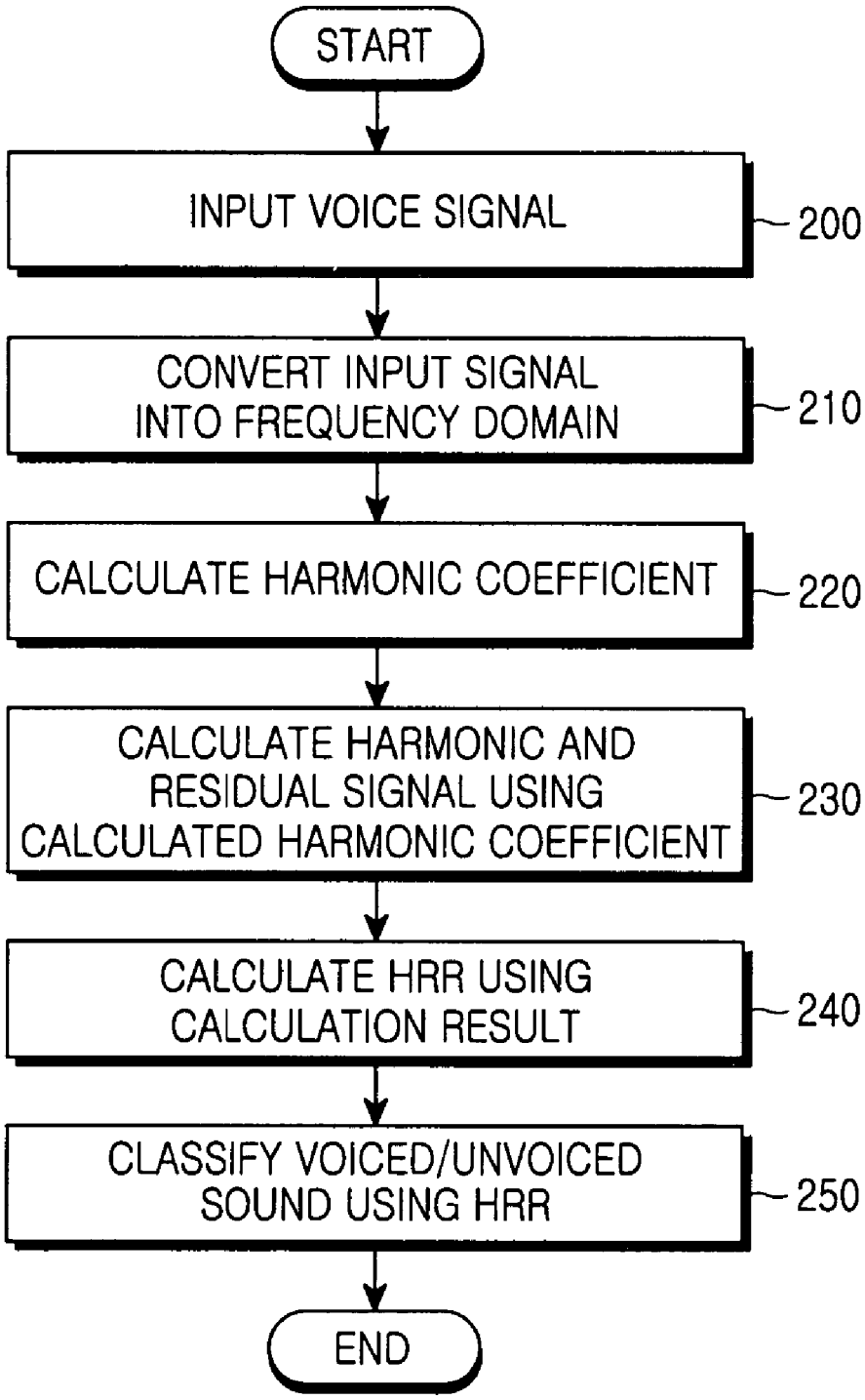
FIG. 2 is a flowchart illustrating a procedure of extracting voiced/unvoiced classification information according to the first embodiment of the present invention.

Hereinafter, a procedure of extracting voiced/unvoiced classification information according to the first embodiment of the present invention will be described with reference to FIG. 2.

In step 200, the voiced/unvoiced classification information extracting apparatus receives a voice signal through a microphone or the like. In step 210, the voiced/unvoiced classification information extracting apparatus converts the received voice signal from a time domain to a frequency domain by using an FFT or the like. Then, the voiced/unvoiced classification information extracting apparatus represents the voice signal as a harmonic sinusoidal model of speech, and calculates a corresponding harmonic coefficient in step 220. In step 230, the voiced/unvoiced classification information extracting apparatus calculates a harmonic signal and a residual signal using the calculated harmonic coefficient. In step 240, the voiced/unvoiced classification information extracting apparatus calculates a harmonic to residual ratio (HRR) by using a calculation result of step 230. In step 250, the voiced/unvoiced classification information extracting apparatus classifies voiced/unvoiced sounds by using the HRR. In other words, voiced/unvoiced classification information is extracted on the basis of the analysis of a harmonic and non-harmonic (i.e. residual) component ratio, and the extracted voiced/unvoiced classification information is used to classify the voiced/unvoiced sounds.

According to the first embodiment of the present invention as described above, an energy ratio between harmonic and noise is obtained by analyzing a harmonic region, which always exists at a higher level than a noise region, thereby extracting voiced/unvoiced classification information which is necessary in all system using voice and audio signals.

Hereinafter, an apparatus and method for extracting voiced/unvoiced classification information according to a second embodiment of the present invention will be described.

Figure 3:
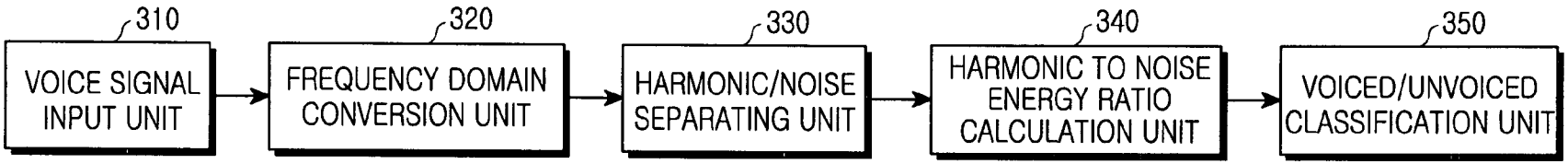
FIG. 3 is a block diagram illustrating the construction of a voiced/unvoiced classification information extracting apparatus according to a second embodiment of the present invention.

FIG. 3 is a block diagram illustrating the construction of an apparatus for extracting voiced/unvoiced classification information according to the second embodiment of the present invention.

The voiced/unvoiced classification information extracting apparatus according to the second embodiment of the present invention includes a voice signal input unit 310, a frequency domain conversion unit 320, a harmonic/noise separating unit 330, a harmonic to noise energy ratio calculation unit 340, and a voiced/unvoiced classification unit 350.

First, the voice signal input unit 310 may include a microphone (MIC), and receives a voice signal including voice and sound signals. The frequency domain conversion unit 320 converts an input signal from a time domain to a frequency domain, preferably using a fast Fourier transform (FFT) or the like in order to convert a voice signal of a time domain into a voice signal of a frequency domain.

The harmonic/noise separating unit 330 separates a frequency domain into a harmonic section and a noise section from the voice signal. In this case, the harmonic/noise separating unit 330 uses pitch information in order to perform the separating operation.

Figure 5:
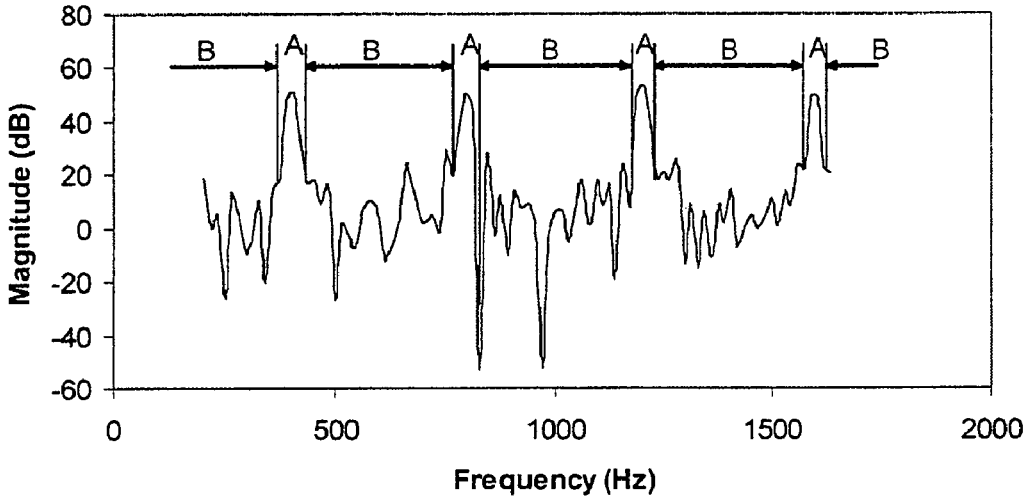
FIG. 5 is a graph illustrating a voice signal of a frequency domain according to the second embodiment of the present invention.

The operation of separating a harmonic part and a noise part from the voice signal will now be described in more detail with reference to FIG. 5. FIG. 5 is a graph illustrating a voice signal of a frequency domain according to the second embodiment of the present invention. As shown in FIG. 5, when a voice signal is subjected to a harmonic-plus-noise decomposition (HND), the voice signal of a frequency domain can be separated into a noise (or stochastic) part "B" and a harmonic (or deterministic) part "A". The HND scheme is widely known, so a detailed description thereof will be omitted.

Figure 6:
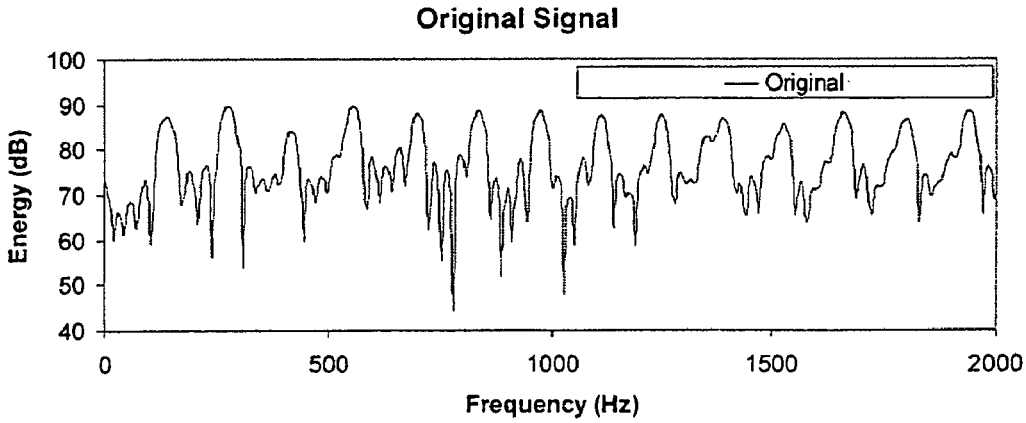
FIG. 6 is a graph illustrating a waveform of an original voice signal before decompression according to the second embodiment of the present invention.
Figure 7A:
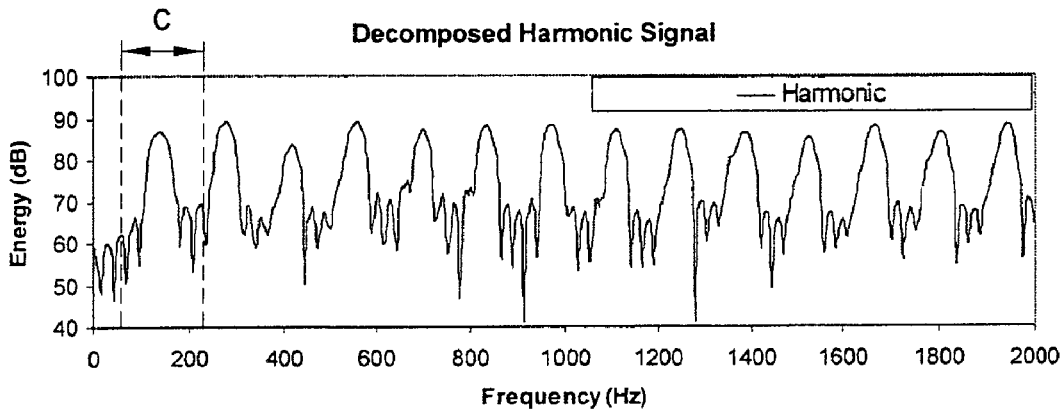
FIG. 7A is a graph illustrating a decompressed harmonic signal according to the second embodiment of the present invention.
Figure 7B:
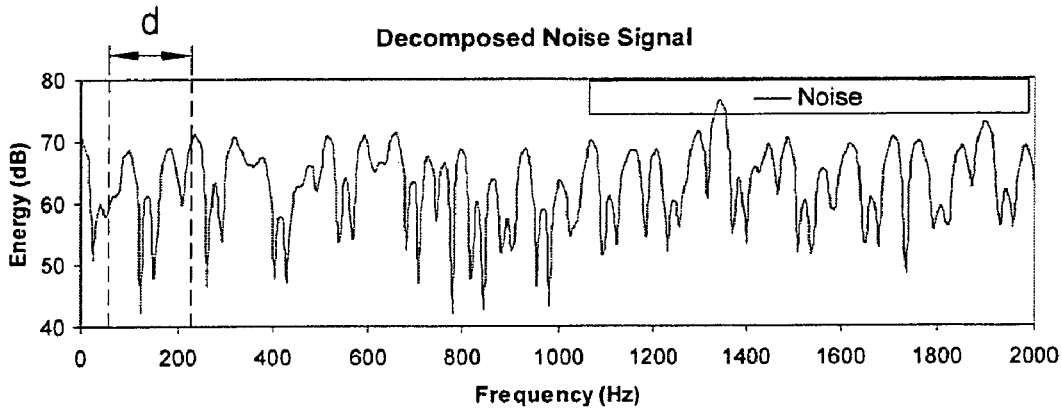
FIG. 7B is a graph illustrating a decompressed noise signal according to the second embodiment of the present invention.

Through the HND, an original voice signal's waveform as shown in FIG. 6 are separated into a harmonic signal and a noise signal, as shown in FIGS. 7A and 7B, respectively. FIG. 6 is a graph illustrating a waveform of an original voice signal before decompression, FIG. 7A is a graph illustrating a decompressed harmonic signal, and FIG. 7B is a graph illustrating a decompressed noise signal, according to the second embodiment of the present invention.

When the decomposed signals are output as shown in FIGS. 7A and 7B, the harmonic to noise energy ratio calculation unit 340 calculates a harmonic to noise energy ratio. In this case, on the basis of the entirety of the harmonic and noise parts, the ratio of the entirety of the harmonic part to the entirety of the noise part may be defined as a harmonic to noise ratio (HNR). In a different manner, the entirety section of the harmonic and noise parts is divided according to each predetermined frequency band, and an energy ratio of a harmonic part to a noise part for each frequency band may be defined as a sub-band harmonic to noise ratio (SB-HNR). When the harmonic to noise energy ratio calculation unit 340 has calculated the HNR or SB-HNR, the voiced/unvoiced classification unit 350 receives the calculated HNR or SB-HNR and can perform an voiced/unvoiced classification operation.

The HNR, which is a signal energy ratio of a harmonic part to a noise part, may be defined as Equation 5. The HNR obtained by such a manner is provided to the voiced/unvoiced classification unit 350. Then, the voiced/unvoiced classification unit 350 performs an voiced/unvoiced classification operation by comparing the received HNR with a threshold value.

$$HNR = 10\log_{10}\left(\sum_k |H(\omega_k)|^2 \Big/ \sum_k |N(\omega_k)|^2\right) \tag{5}$$

Referring to FIGS. 7A and 7B, the HNR defined as Equation 5 corresponds to a value obtained by dividing the lower region of the waveform shown in FIG. 7A by the lower region of the waveform shown in FIG. 7B. That is, the lower regions of the waveforms shown in FIGS. 7A and 7B represent energy.

Figure 4:
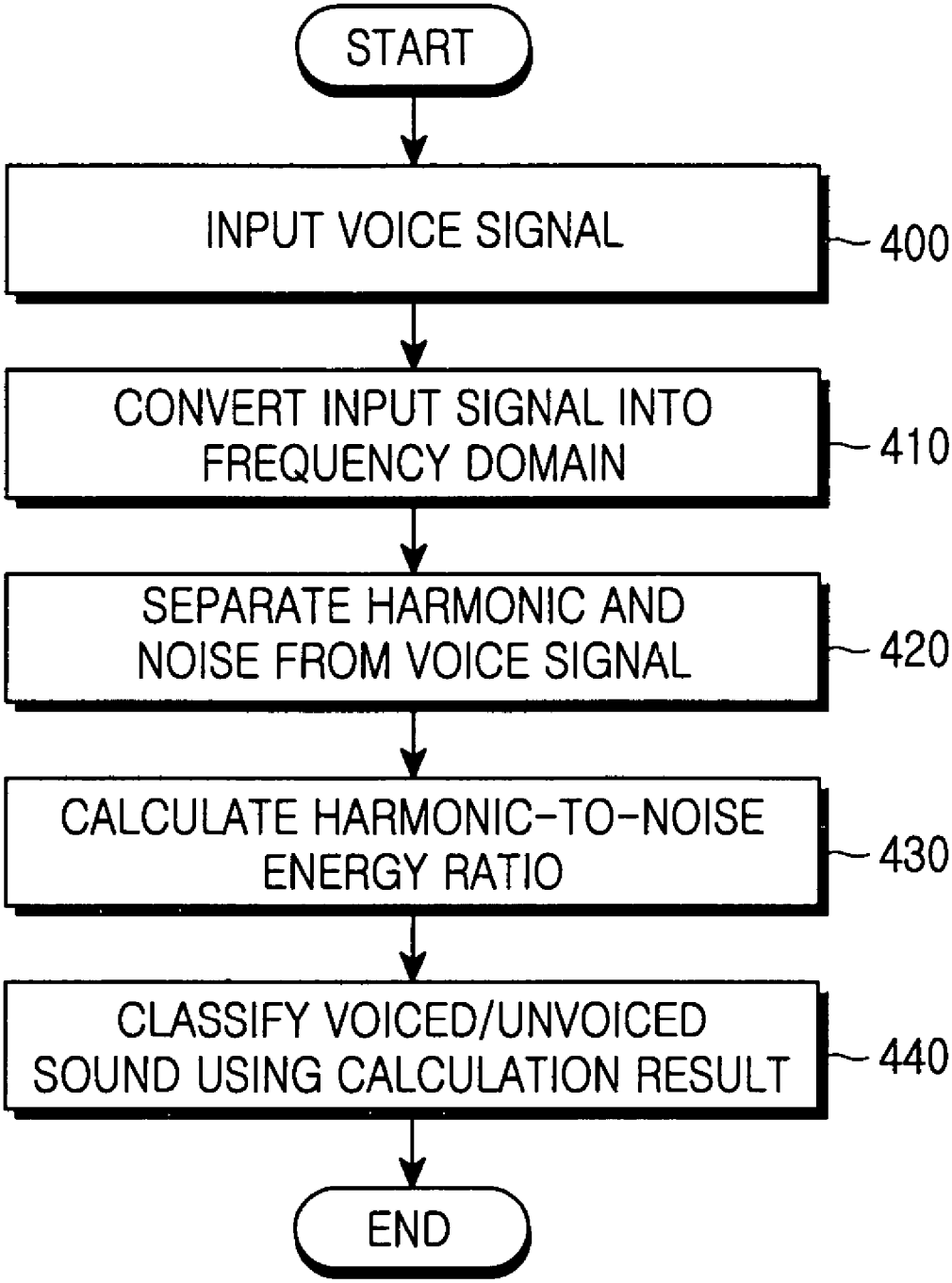
FIG. 4 is a flowchart illustrating a procedure of extracting voiced/unvoiced classification information according to the second embodiment of the present invention.

A method for extracting voiced/unvoiced classification information according to the second embodiment of the present invention will now be described with reference to the flowchart of FIG. 4. In step 400, the voiced/unvoiced classification information extracting apparatus receives a voice signal through a microphone or the like. In step 410, the voiced/unvoiced classification information extracting apparatus converts the received voice signal of a time domain to a voice signal of a frequency domain by using an FFT or the like. In step 420, the voiced/unvoiced classification information extracting apparatus separates a harmonic part and a noise part from the voice signal of the frequency domain. The voiced/unvoiced classification information extracting apparatus calculates a harmonic to noise energy ratio in step 430, and proceeds to steps 440, in which the voiced/unvoiced classification information extracting apparatus classifies voiced/unvoiced sounds by using the calculation result of step 430.

Meanwhile, a feature extracting method of the present invention may be re-defined such that a value obtained by comparing the HNR or HRR with a threshold value is included in a range of [0,1] ("0" for an unvoiced sound and "1" for a voiced sound) so as to be coherent. In detail, the HNR and HRR must be expressed in a unit of dB. However, in order to use a measure representing a degree of voicing, for example, in the case of the HNR, Equation 5 may be re-defined as shown in Equation 6.

$$HNR = 10\log_{10}\frac{P_H}{P_N}(\text{dB}) \tag{6}$$

In Equation 6, "P" represents a power, in which "$P_N$" is used for the HNR while "$P_R$" is used for the HRR, which may change depending on measures. The range for a voiced sound is infinite, while the range for an unvoiced sound is negative infinite. Also, in Equation 6, if $$\frac{P_H}{P_N} = 10^{HNR/10},$$

a measure between [0,1], which represents a degree of voicing, then Equation 6 may be expressed as Equation 7.

$$\delta = \frac{P_H}{P_H + P_N} = \frac{10^{HNR/10}}{10^{HNR/10} + 1} \tag{7}$$

Meanwhile, fundamentally, since a residual is regarded as noise in a procedure, an HNR corresponding to voiced/unvoiced classification information according to the second embodiment of the present invention may have the same concept as the HRR. However, while a residual is used in view of sinusoidal representation for the HRR according to the first embodiment of the present invention, a noise is calculated after a harmonic-plus-noise decompression operation is performed for the HNR according to the second embodiment of the present invention.

A mixed voicing shows a tendency to be periodic in a lower frequency band but to be noise-like in a higher frequency band. In this case, harmonic and noise components, which have been obtained through a decompression operation, may be low-pass-filtered before an HNR is calculated using the components.

Meanwhile, in order to prevent a problem that may occur when a great energy difference exists between frequency bands, a method for extracting voiced/unvoiced classification information according to a third embodiment of the present invention is proposed. In the third embodiment of the present invention, an energy ratio between a harmonic component and a noise component for a sub-band is defined as a sub-band harmonic to noise ratio (SB-HNR). Particularly, the third method eliminates a problem that may occur when a high energy band dominates an HNR to generate an unvoiced segment having too great an HNR value, and can better control each band.

According to the third embodiment in order to calculate an entire ratio, an HNR is calculated for each harmonic part before HNRs are added, so that it is possible to more efficiently normalize each harmonic part than the other parts. In detail, referring to FIGS. 7A and 7B, an HNR is obtained from a band indicated by reference mark "c" in FIG. 7A and a band indicated by reference mark "d" in FIG. 7B. After the frequency bands shown in FIGS. 7A and 7B is divided into a plurality of frequency bands, each of which has a predetermined size, in such a manner, an HNR is calculated for each band, thereby obtaining SB-HNRs. The SB-HNR may be defined as Equation 8.

$$SB-HNR = 10\sum_{n-1}^{N}\log_{10}\left(\sum_{\omega_k=\Omega_k^-}^{\Omega_k^+}|H(\omega_k)|^2 \Big/ \sum_{\omega_k=\Omega_k^-}^{\Omega_k^+}|N(\omega_k)|^2\right) \tag{8}$$

In Equation 8, "$\Omega_n^+$" represents an upper frequency bound of an $n^{th}$ harmonic band, "$\Omega_n^{31}$" represents a lower frequency bound of an $n^{th}$ harmonic band, and "N" represents the number of sub-bands. In the case of FIGS. 7A and 7B, the SB-HNR may be defined as follows: SB-HNR=Σ Region of FIG. 7A per Harmonic Band/Region of FIG. 7B per Harmonic Band.

It is defined that one sub-band is centered on a harmonic peak and extends in both directions from the harmonic peak by a half pitch. These SB-HNRs more efficiently equalize the harmonic regions as compared with the HNR, so that every harmonic region has a similar weighting value. Also, the SB-HNR is regarded as an analog of a frequency axis for a segmental SNR of a time axis. Since each HNR for every sub-band is calculated, the SB-HNR can provide a more precise foundation for voiced/unvoiced classification. Herein, a bandpass noise-suppression filter (e.g. ninth order Butterworth filter with a lower cutoff frequency of 200 Hz and an upper cutoff frequency of 3400 Hz) is selectively applied. Such a filtering provides a proper high frequency spectral roll-off, and simultaneously has an effect of de-emphasizing the out-of-band noise when there is a noise.

As described above, the feature extracting method of the present invention is simple as well as practical, and is also very precise and efficient in measuring a degree of voicing. The harmonic classification and analysis methods for extracting a degree of voicing according to the present invention can be easily applied to various voice and audio feature extracting methods, and also enables more precise voiced/unvoiced classification when being connected with the existing methods.

Such a harmonic-based technique, for example the SB-HNR, may be applied to various fields, such as a multi-band excitation vocoder which is necessary to classify voiced/unvoiced sounds for each sub-band. In addition, since the present invention is based on analysis of dominant harmonic regions, the present invention is expected to have great utility. Also, since the present invention emphasizes a frequency domain, which is actually important in voiced/unvoiced classification, in consideration of auditory perception phenomena, the present invention is expected to have a superior performance. Furthermore, the present invention can actually be applied to coding, recognition, reinforcement, composition, etc. Particularly, since the present invention requires a small amount of calculation and detects a voiced component using precisely-detected harmonic part, the present invention can be more efficiently applied to applications (which requires mobility or rapid processing, or has a limitation in the capacity for calculation and storage such as in a mobile terminal, telematics, PDA, MP3, etc.), and may also be a source technology for all voice and/or audio signal processing systems.

While the present invention has been shown and described with reference to certain preferred embodiments thereof, it will be understood by those skilled in the art that various changes in form and details may be made therein without departing from the spirit and scope of the invention as defined by the appended claims. Accordingly, the scope of the invention is not to be limited by the above embodiments but by the claims and the equivalents thereof.

What is claimed is:

1. A method for extracting voiced/unvoiced classification information using a harmonic component of a voice signal, the method comprising the steps of:

converting, by a frequency domain conversion unit, an input voice signal into a voice signal of a frequency domain;

calculating, by a harmonic-residual signal calculation unit, a harmonic signal and a residual signal other than the harmonic signal from the converted voice signal;

calculating, by a Harmonic to Residual Ratio (HRR) calculation unit, HRR using a calculation result of the harmonic signal and residual signal; and classifying, by a voiced/unvoiced classification unit, voiced/unvoiced sounds by comparing the HRR with a threshold value, wherein calculating the HRR comprises obtaining a harmonic energy using the calculated harmonic signal and the residual signal, calculating a residual energy by subtracting the harmonic energy from an entire energy of the voice signal, and calculating a ratio of the calculated harmonic energy to the calculated residual energy.

2. The method as claimed in claim 1, wherein the converted voice signal is expressed as:

$$S_n = a_0 + \sum_{k=1}^{L} (a_k \cos n\omega_0 k + b_k \sin n\omega_0 k) + r_n \quad (n = 0, 1, \ldots N-1) \tag{1}$$
$$= h_n + r_n$$

wherein "$S_n$" represents the converted voice signal, "$r_n$" represents a residual signal, "$h_n$" represents a harmonic component (harmonic signal), "N" represents a length of a frame, "L" represents the number of existing harmonics, "$\omega_{ij}$" represents a pitch, k is a frequency bin number and "a" and "b" are constants which have different values depending on frames.

3. The method as claimed in claim 2, wherein the step of calculating the harmonic signal and the residual signal other than the harmonic signal comprises:

calculating a relevant harmonic coefficient so as to minimize the residual energy;

obtaining the harmonic signal using the calculated harmonic coefficient; and calculating the residual signal by subtracting the harmonic signal from the converted voice signal when the harmonic signal has been obtained.

4. The method as claimed in claim 3, wherein the harmonic coefficient is calculated in the same manner as a least squares scheme.

5. The method as claimed in claim 3, wherein the residual energy is expressed as:

$$E = \sum_{n=0}^{N-1} r_n^2.$$

6. The method as claimed in claim 5, wherein, in calculating the relevant harmonic coefficient, "$\partial E/\partial a_k = 0$" and "$\partial E/\partial b_k = 0$" are calculated with respect to every "k" in the equation for the residual energy.

7. The method as claimed in claim 1, wherein the frequency domain conversion unit, the harmonic-residual signal calculation unit, the HRR calculation unit and the voiced/unvoiced classification unit are included in a single apparatus.

8. The method as claimed in claim 1, wherein the HRR is expressed as:

$$HRR = 10 \log_{10}\left(\sum h_n^2 \Big/ \sum r_n^2\right)\text{dB}.$$

9. The method as claimed in claim 1, wherein, when Parseval's theorem is used, the HRR is expressed in a frequency domain as:

$$HRR = 10\log_{10}\left(\sum_k |H(\omega_k)|^2 \Big/ \sum_k |R(\omega_k)|^2\right)\text{dB}$$

where H indicates harmonic component $h_n$, R indicates residual signal $r_n$ and wherein "ω" represents a frequency bin.

10. The method as claimed in claim 1, wherein, in classifying the voiced/unvoiced sounds by comparing the HRR with the threshold value, a voice signal is determined and classified as being a voiced sound when the HRR of the voice signal is greater than the threshold value.

11. A method for extracting voiced/unvoiced classification information using a harmonic component of a voice signal, the method comprising the steps of:

converting, by a frequency domain conversion unit, an input voice signal into a voice signal of a frequency domain;

separating, by a harmonic/noise separating unit, a harmonic part and a noise part from the converted voice signal;

calculating, by a harmonic to noise energy ratio calculation unit, an energy ratio of the harmonic part to the noise part; and classifying, by a voice/unvoiced classification unit, voiced/unvoiced sounds using a result of the calculation by comparing the energy ratio with a threshold value.

12. The method as claimed in claim 11, wherein the energy ratio of the harmonic part to the noise part is an energy ratio (HNR) of all harmonic parts to all noise parts.

13. The method as claimed in claim 12, wherein the HNR is expressed as:

$$HNR = 10\log_{10}\left(\sum_k |H(\omega_k)|^2 \Big/ \sum_k |N(\omega_k)|^2\right),$$

where H is a harmonic signal, N is a noise signal and $\acute{\omega}$ is a frequency bin.

14. The method as claimed in claim 11, wherein the energy ratio of the harmonic part to the noise part is an energy ratio (SB-HNR) of a sub-band harmonic part to a noise part for each predetermined frequency band.

15. The method as claimed in claim 14, wherein the SB-HNR is expressed as:

$$SB-HNR = 10\sum_{n-1}^{N} \log_{10}\left(\sum_{\omega_k=\Omega_k}^{\Omega_k^+} |H(\omega_k)|^2 \Big/ \sum_{\omega_k=\Omega_k^-}^{\Omega_k^+} |N(\omega_k)|^2\right),$$

wherein "$\Omega_n^-$" represents an upper frequency bound of an $n^{th}$ harmonic band, "$\Omega_n^-$" represents a lower frequency bound of an $n^{th}$ harmonic band, and "N" represents the number of sub-bands.

16. The method as claimed in claim 11, wherein the frequency domain conversion unit, the harmonic/noise separating unit, the harmonic to noise energy ratio calculation unit and the voiced/unvoiced classification unit are included in a single apparatus.

17. An apparatus for extracting voiced/unvoiced classification information using a harmonic component of a voice signal, the apparatus comprising:

a voice signal input unit for receiving a voice signal;

a frequency domain conversion unit for converting the received voice signal of a time domain into a voice signal of a frequency domain;

a harmonic-residual signal calculation unit for calculating a harmonic signal and a residual signal other than the harmonic signal from the converted voice signal;

a Harmonic to Residual Ratio (HRR) calculation unit for calculating an energy ratio of the harmonic signal to the residual signal by using a calculation result of the harmonic-residual signal calculation unit; and a voiced/unvoiced classification unit for classifying voiced/unvoiced sounds by comparing the calculated enemy ration with a threshold value, wherein the HRR calculation unit obtains a harmonic energy by using the harmonic signal and the residual signal, and calculates a residual energy by subtracting the harmonic energy from an entire energy of the voice signal.

18. The apparatus as claimed in claim 17, wherein the HRR is expressed as:

$$HRR = 10\ \log_{10}\left(\sum h_n^2 \Big/ \sum r_n^2\right)\text{dB}.$$

Where "$h_n$" represents a harmonic signal, and "$r_n$" represents a residual signal.

19. The apparatus as claimed in claim 17, further comprising:

a harmonic coefficient calculation unit for calculating a relevant harmonic coefficient so as to minimize an energy of the residual signal in the voice signal expressed using a harmonic model, which is expressed as a sum of harmonics of a fundamental frequency and a small residual; and a pitch detection unit for providing a pitch required for the calculation of the harmonic coefficient.

20. An apparatus for extracting voiced/unvoiced classification information using a harmonic component of a voice signal, the apparatus comprising:

a voice signal input unit for receiving a voice signal;

a frequency domain conversion unit for converting the received voice signal of a time domain into a voice signal of a frequency domain;

a harmonic/noise separating unit for separating a harmonic part and a noise part from the converted voice signal;

a harmonic to noise energy ratio calculation unit for calculating an energy ratio of the harmonic part to the noise part; and a voiced/unvoiced classification unit for classifying voiced/unvoiced sounds by comparing the calculated energy ratio within a threshold value.

21. The apparatus as claimed in claim 20, wherein the harmonic to noise energy ratio calculation unit calculates an energy ratio (HNR) of all harmonic parts to all the noise parts.

22. The apparatus as claimed in claim 21, wherein the HNR is expressed as:

$$HNR = 10\log_{10}\left(\sum_k |H(\omega_k)|^2 \Big/ \sum_k |N(\omega_k)|^2\right),$$

Where "$\acute{\omega}$" is a frequency bin, H is a harmonic signal, N is a noise signal and K is a frequency bin number.

23. The apparatus as claimed in claim 20, wherein the harmonic to noise energy ratio calculation unit calculates an energy ratio (SB-HNR) of a sub-band harmonic part to a noise part for each predetermined frequency band.

24. The apparatus as claimed in claim 23, wherein the SB-HNR is expressed as $$SB-HNR = 10\sum_{n-1}^{N} \log_{10}\left(\sum_{\omega_k=\Omega_k}^{\Omega_k^+} |H(\omega_k)|^2 \Big/ \sum_{\omega_k=\Omega_k^-}^{\Omega_k^+} |N(\omega_k)|^2\right),$$

wherein "$\Omega_n^+$" represents an upper frequency bound of an $n^{th}$ harmonic band, "$\Omega_n^-$" represents a lower frequency bound of an $n^{th}$ harmonic band, and "N" represents the number of sub-bands.

* * * * *